United States Patent [19]

Watanabe et al.

[11] 4,084,990

[45] Apr. 18, 1978

[54] PROCESS FOR FABRICATION OF DECORATIVE PANEL

[75] Inventors: Kisuke Watanabe, Tokyo; Tsuneji Takasugi, Iruma, both of Japan

[73] Assignee: Citizen Watch Company Limited, Tokyo, Japan

[21] Appl. No.: 752,600

[22] Filed: Dec. 20, 1976

[30] Foreign Application Priority Data

Dec. 26, 1975 Japan ..... 50-157167

[51] Int. Cl.[2] ..... C22F 1/02; C22F 1/08; C22F 1/14

[52] U.S. Cl. ..... 148/11.5 R; 148/11.5 C

[58] Field of Search ..... 148/11.5 R, 11.5 A, 148/11.5 C, 12.1

[56] References Cited

U.S. PATENT DOCUMENTS

| | | | |
|---|---|---|---|
| 2,941,930 | 6/1960 | Mostovych et al. | 148/11.5 A |
| 3,180,806 | 4/1965 | Hollingsworth | 148/11.5 A |
| 3,773,576 | 11/1973 | Pond | 148/11.5 A |
| 3,827,952 | 8/1974 | Franz | 148/11.5 A |
| 3,891,472 | 6/1975 | Yoshida et al. | 148/11.5 A |

*Primary Examiner*—W. Stallard

*Attorney, Agent, or Firm*—Frank J. Jordan

[57] ABSTRACT

A method for the fabrication of a decorative panel having a coarse, enlarged crystalline pattern characterized by applying a large rolling force at a draft ratio in excess of the critical draft ratio to a metal sheet; annealing the metal sheet at a temperature in excess of the recrystallization temperature in order to remove deformations caused by the rolling step; applying a prescribed pattern-like strain figures thereto; annealing the metal sheet in an anti-oxidizing atmosphere at a high temperature in excess of the recrystallization temperature in order to allow coarse, enlarged crystals to form; and subsequently etching the surface of the sheet.

11 Claims, 5 Drawing Figures

PROCESS FOR FABRICATION OF DECORATIVE PANEL

This invention relates to a process for the fabrication of a decorative panel having a coarse, enlarged crystalline pattern characterized in that a metal sheet is drastically rolled and then annealed to allow the growth of crystals.

A conventional method proposes that a raw material be lightly rolled, on the order of 5% in draft ratio, annealed at a temperature above the recrystallization temperature and then subject to an etching treatment in order to produce a macrocrystalline pattern which is subsequently applied to a decorative article. Crystalline patterns brought forth by such methods, however, are monotonous, offer little variation and are rather uninteresting.

It is, therefore, an object of the present invention to provide a new method of fabricating a decorative panel having a coarse, enlarged crystalline pattern.

It is another object of the present invention to provide a method of fabricating a novel coarsely enlarged crystalline pattern in which the crystal particles possess directionality and present a complex appearance extremely rich in variations.

The process of the present invention is characterized by applying a strong rolling force at a draft ratio in excess of the critical draft ratio to a pure metal sheet or an alloyed metal sheet, and annealing the pure metal or alloyed sheet in an anti-oxidizing atmosphere at a high temperature in excess of the recrystallization temperature of the material to establish a coarsely enlarged crystalline pattern. A secondary crystalline pattern is formed on the coarsely enlarged crystalline pattern by annealing the metal sheet at a temperature above the recrystallization temperature after the rolling step to remove deformations and subsequently applying strain figures of a prescribed pattern onto the metal sheet.

These and other objects, features and advantages of the present invention will become more apparent from the following description when taken in conjunction with the acompanying drawings, in which.

Figure 1:
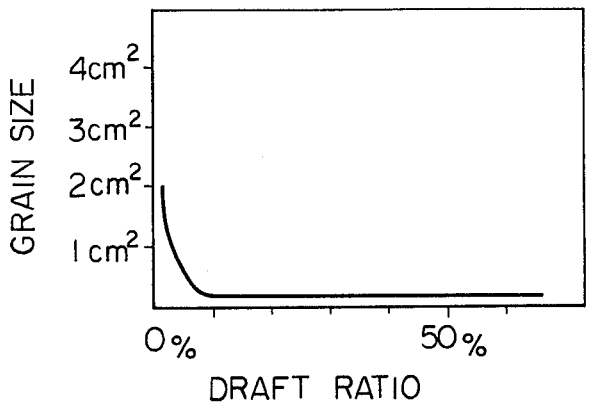
Fig. 1 PRIOR ART
FIG. 1 is a graph showing the relationship between grain size and draft ratio for crystals which are coarsened and enlarged by a conventional method.
Figure 3:
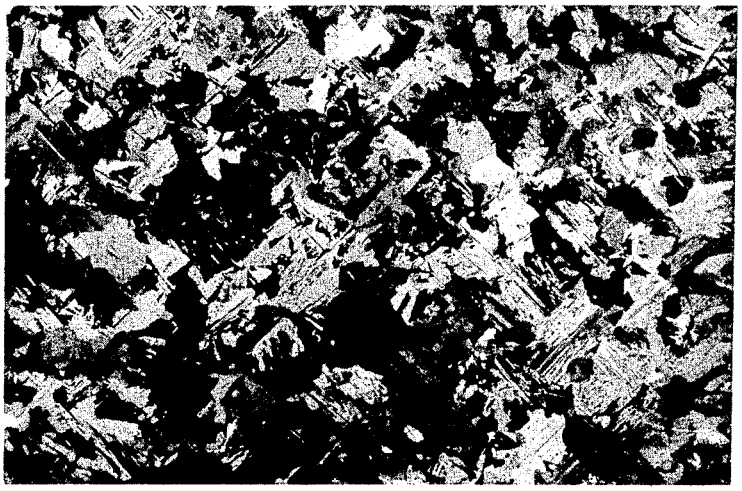
FIG. 3 shows a macrostructure of a metal sheet formed with a crystalline pattern in accordance with a conventional method.

Referring now to FIG. 1, there is shown a graph showing the relationship between crystal size and draft ratio for crystals which are coarsened and enlarged by a conventional method. In a conventional decorative panel fabrication method, it has been a common practice to lightly roll a metal sheet on the order of 5% in draft ratio. The grain size is relatively small, i.e., about 0.5 $cm^2$, and crystal patterns are monotonous, offer little variation and are rather uninteresting as shown in FIG. 3.

The present invention comtemplates the provision of a novel method for the fabrication of a decorative panel which overcomes the aforementioned drawbacks.

The process for the formation of a coarse crystalline pattern in accordance with the invention may preferably comprise a rolling step, an annealing step for the removal of deformations caused by the rolling step, a step for the application of strain figures of a prescribed pattern, and an annealing step in which a coarse, enlarged crystalline pattern is allowed to grow. In order to obtain a sufficiently coarse, enlarged crystalline pattern through the application of this process it is necessary to apply a strong rolling force at or above a specified high draft ratio which is a great deal higher than the normal draft ratio. This minimum required draft ratio will hereinafter be referred to as a critical draft ratio. With pure copper as an example, this ratio will be explained by way of FIG. 2.

Figure 2:
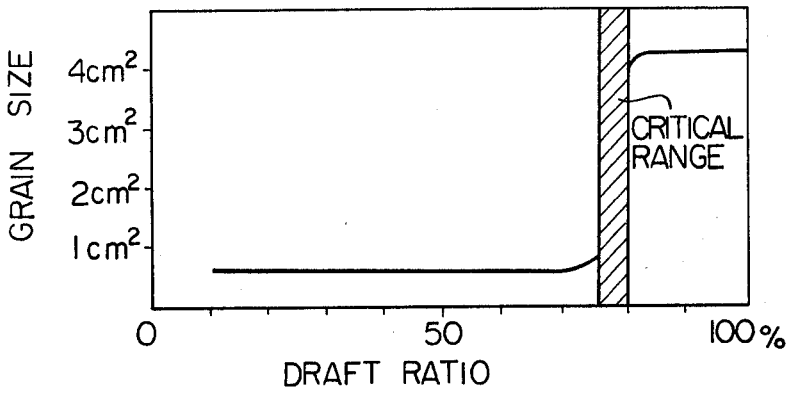
FIG. 2 is a graph showing the same relationship for crystals coarsened and enlarged according to the method of this invention.

FIG. 2 shows the relation between the grain size after the coarsening and enlargement annealing step and the draft ratio when crystal coarsening and enlargement is effected through a process in which pure copper is rolled, annealed at 400° C. for 1 hour to remove deformations, applied with strain figures of a predetermined pattern and then annealed at 900° C for 1 hour to coarsen and enlarge the crystals. As will be appreciated from the drawing, grain size undergoes a great change following the coarsening and enlargement annealing step in the area of the graph where the draft ratio is between 75 and 80%; it is apparent that grain size shows little growth below a 75% draft ratio where growth is quite sudden in excess of an 80% draft ratio. It follows therefore that rolling at a draft ratio of at least 80% is required to obtain coarse, enlarged crystals of pure copper. This is the critical draft ratio peculiar to pure copper; other metals will similarly possess a characteristic critical draft ratio. Metals used in the present invention are either pure metals or alloyed metals prepared by adding different metals to a pure metal in an amount of 10% or less.

Figure 4A:
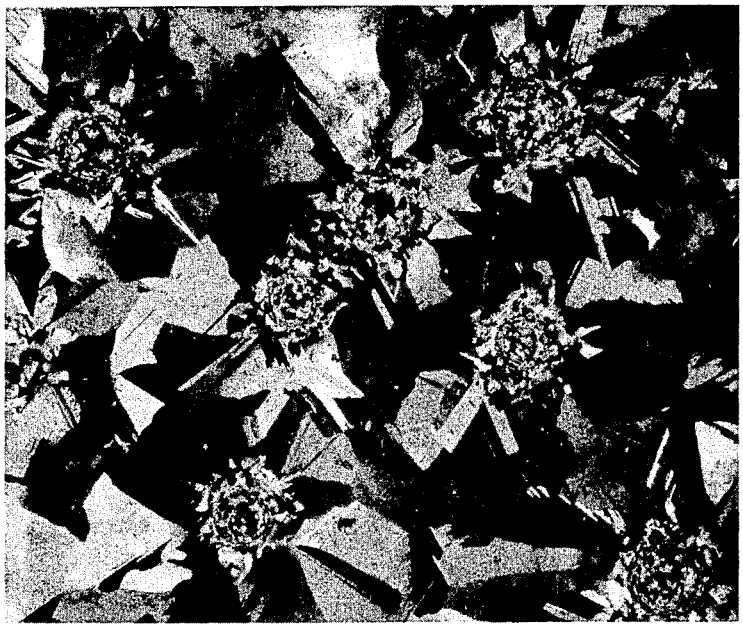
FIGS. 4A and 4B show examples of crystalline patterns formed in a metal sheet in accordance with the method of this invention.
Figure 4B:
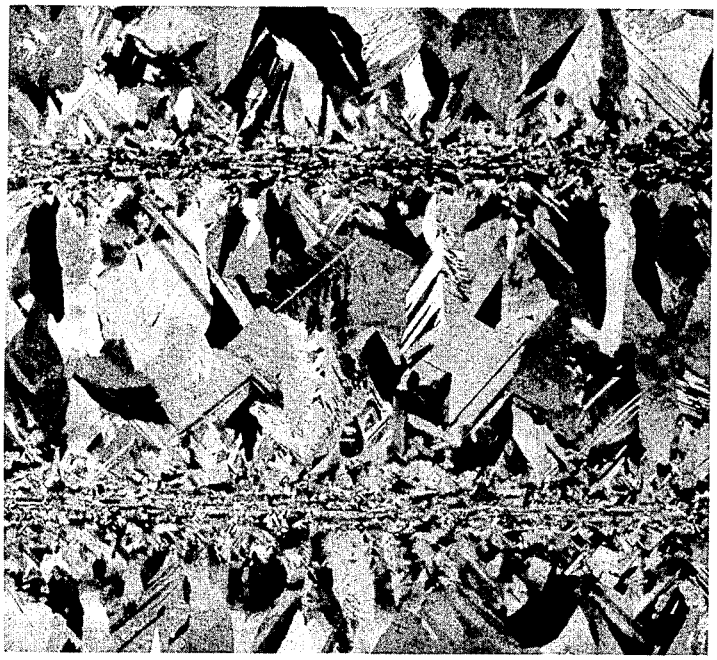

In a specific embodiment of the invention, a sheet of pure copper having a thickness of 6mm was reduced to a thickness of 1mm by rolling at a critical draft ratio in excess of 80%. The sheet was then annealed in an anti-oxidizing atmosphere composed of a hydrogen($H_2$) gas for one hour at a temperature of 400° C in order to remove deformations caused by rolling, stamped to provide a pattern-like strain figures and thereafter annealed in the anti-oxidizing atmosphere for 1 hour at 800° C to permit the growth of coarse, enlarged crystals. This was followed by etching using a mixture of hydrochloric and nitric acid which brought the roughened, enlarged crystals to the surface which was subsequently flattened by means of a flat punch. This product was then silver plated to provide a heretofore unobtainable decorative panel possessing directionality and an attractive seashell-like appearance rich in variation as shown in FIG. 4A. The crystal grains formed in the sheet shown in FIG. 4A are extremely larger in size than those formed in the sheet shown in FIG. 3. The seashell-like crystals shown in FIG. 4A are the result of the stamping step which is performed by using a punch or press having a ring-like head to produce ring-like deformations in arbitrary positions of the metal sheet. FIG. 4B shows that the metal sheet has a first pattern of coarse crystals and a second pattern of crystals formed along straight lines by stamping the sheet on straight wires.

Thus in accordance with the method of the present invention, a material is strongly rolled at a draft ratio in excess of the critical draft ratio peculiar to that material and annealed in an anti-oxidizing atmosphere at a high temperature in excess of the recrystallization temperature to allow the coarse, enlarged crystals as shown in FIGS. 4A and 4B. Before this annealing step a portion of the material may be provided with strain figures of any configuration by which pattern-like crystals are formed. This produces a decorative panel with a novel coarse crystalline pattern rich in variations by allowing coarse, enlarged crystals having directionality to grow from that portion of the material provided with the strain figures.

While the present invention has been shown and described with reference to particular examples, it should be noted that various other changes or modifications may be made without departing from the scope of the present invention. For example, the metal sheet may be rolled by rollers coated with sheets of vinyl chloride or by rollers provided their outer peripheries with thin films of liquid having high viscosity instead of etching step by which the coarse, enlarged crystal pattern is brought to the surface of the metal sheet. In addition, the anti-oxidizing atmosphere may be composed of nitrogen gases or inactive gases such as argon or helium. Although one example has been described with reference to copper, it should be understood that other metals such as silver or gold may be used as the materials for the sheet on which the coarse, enlarged crystals are formed.

What is claimed is:

1. A method of forming a coarse, enlarged crystalline pattern on a metal sheet which comprises the steps of: (a) rolling the metal sheet at a draft ratio in excess of a critical draft ratio peculier to the metal sheet; and (b) annealing the metal sheet in an anti-oxidizing atmosphere at a first predetermined temperature in excess of a recrystallization temperature to allow coarse, enlarged crystals to form.

2. A method according to claim 1, further comprising the steps of: annealing the metal sheet at a second predetermined temperature in excess of the recrystallization temperature before the step (b) to remove deformations caused during the step (a); and subsequently applying strain figures in a predetermined pattern onto the metal sheet.

3. A method according to claim 2, further comprising the step of: etching the surface of the metal sheet after the step (b).

4. A method according to claim 3, in which the metal sheet comprises copper.

5. A method according to claim 4, in which the critical draft ratio is at least 80%.

6. A method according to claim 2, in which the anti-oxidizing atmosphere comprises inactive gases.

7. A method according to claim 6, in which the inactive gases comprise argon gases.

8. A method according to claim 6, in which the inactive gases comprise helium gases.

9. A method according to claim 2, in which the anti-oxidizing gases comprise nitrogen gases.

10. A method according to claim 2, in which the anti-oxidizing gases comprise hydrogen gases.

11. A method according to claim 4, in which the first predetermined temperature is about 800° C and the second predetermined temperature is about 400° C.

* * * * *